United States Patent [19]

Dew

[11] Patent Number: 4,890,675

[45] Date of Patent: Jan. 2, 1990

[54] HORIZONTAL DRILLING THROUGH CASING WINDOW

[76] Inventor: Edward G. Dew, 15314 Barbarossa, Houston, Tex. 77083

[21] Appl. No.: 321,414

[22] Filed: Mar. 8, 1989

[51] Int. Cl.[4] ..... E21B 7/04; E21B 17/00; E21B 29/02

[52] U.S. Cl. ..... 166/376; 175/61; 175/62

[58] Field of Search ..... 166/376, 297, 298, 307, 166/50, 55; 175/61, 62, 73, 78, 79

[56] References Cited

U.S. PATENT DOCUMENTS

| | | | |
|---|---|---|---|
| 2,261,292 | 11/1941 | Salnikov | 166/376 X |
| 2,383,496 | 8/1945 | Nebolsine | 175/62 |
| 2,436,198 | 2/1948 | Cardwell et al. | 166/376 X |
| 2,725,942 | 12/1955 | McCullough | 166/376 X |
| 4,051,908 | 10/1977 | Driver | 175/78 |

*Primary Examiner*—Stephen J. Novosad

[57] ABSTRACT

A chemically removable casing section is spotted in a casing string opposite a formation through which a horizontal borehole is to be drilled. The casing section is selectively dissolved by a chemical solution, and a horizontal borehole is drilled into the formation through the window in the casing string.

7 Claims, 2 Drawing Sheets

HORIZONTAL DRILLING THROUGH CASING WINDOW

BACKGROUND OF THE INVENTION

This invention relates to drilling of horizontal boreholes through subterranean formations, and more particularly to drilling of horizontal boreholes through formations traversed by a cased well.

There is a renewed interest in horizontal drainholes in the petroleum industry. Used in the proper reservoirs, horizontal drainholes can provide an economic alternative to vertical wells with or without stimulation. Since the horizontal well concept was introduced in the 1930's, drilling, completion, and production technology have significantly improved. The applications for drainhole technology have generally fallen into five categories. The first is in high permeability formations. A second application is for reservoirs which have heterogeneous permeability distribution, such as naturally fractured formations. The third is for increased production rates where water or gas coning is a problem. A fourth is to improve the areal sweep efficiency of secondary and tertiary recovery projects. The final application is in thermally enhanced recovery of heavy oil, such as steam floods and fire floods. Horizontal wells can provide higher production rates, improved recoveries, better areal sweep, and can reduce the need for additional wells.

SUMMARY OF THE INVENTION

According to the present invention, a method for drilling horizontal boreholes through a formation traversed by a cased well is provided. The method comprises providing a casing section adjacent the formation which is readily soluble in a selected chemical solution, contacting the casing section with the selected chemical solution to dissolve the casing section and provide a "window" to the formation, and then drilling at least one generally horizontal borehole through the window into the formation.

THE DRAWINGS

DESCRIPTION OF THE PREFERRED EMBODIMENTS

Figure 2:
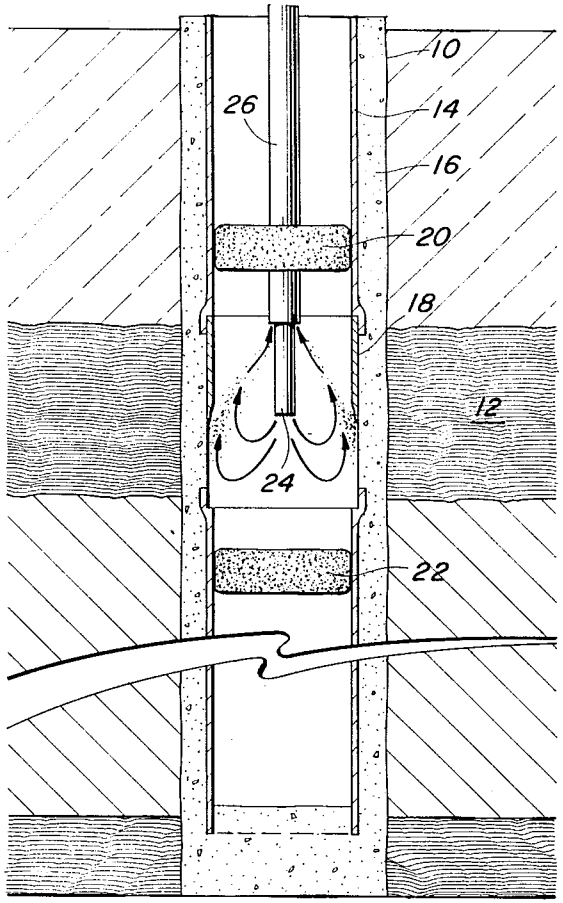
FIG. 2 is a cross sectional view illustrating the technique for removing the soluble casing section.

There are several situations in which a generally horizontal borehole provides improved results compared to a generally vertical borehole extending through a formation.

Applications for horizontal borehole technology have generally fallen into five categories. The first is in high permeability formations. In high permeability formations, the pressure drop due to radial flow in the formation may be as low or lower than the pressure drop due to flow down the fracture. Consequently, a horizontal well will produce at a higher rate than a hydraulic fracture of the same length. The second category is reservoirs which have heterogeneous permeability distribution. The horizontal wellbore may enhance contributions by the best permeability if properly oriented. The third category is for increased production rates where water or gas coning is a problem. A horizontal wellbore in the oil zone may make it possible to obtain higher production rates without coning. The fourth is for improvement of areal sweep efficiencies in secondary and tertiary operations. Horizontal wells can be oriented in line drives and five spot or other patterns to provide very efficient sweep patterns. The horizontal wells improve total flood recovery and improve injection rates. With higher injection rates which are evenly distributed in the formation, higher production rates can be sustained. The final category is for thermally enhanced recovery projects for heavy oil such as steam floods and fire floods. Multiple horizontal wellbores provide additional surface area in the reservoir for heat transfer and, therefore, make the heating cycle more effective.

In cases where there are multiple producing or injection formations, or where it is desirable to have a cased section below the formation through which the horizontal borehole is to drilled, such as to provide a protected area for pumping equipment, a well traversing a producing or injection formation is first drilled and cased, and then a window in the casing is created and a generally horizontal borehole is drilled through the window in accordance with the invention.

In the past, the window in the casing string has been created by use of a section mill to cut away the casing opposite the formation of interest. This usually involves use of more than one section mill, or periodic redressing of a section mill, and can take several days.

The preferred embodiment of the present invention involves spotting a chemically removable section of casing opposite the formation of interest, and then contacting the removable casing section with a chemical solution which preferentially dissolves the removable section, followed by drilling a generally horizontal borehole through the thus created window in the casing string.

The removable casing section is formed of material which is strong enough to support the casing below the removable section, and yet readily soluble in a selected chemical solution which does not readily dissolve the remainder of the casing. Preferably, the removable section is formed of aluminum or magnesium, or an alloy of aluminum or magnesium. The selected chemical solution may be an acid or an alkali. To minimize damage to the rest of the casing, a caustic solution is preferred. A strong solution of alkali metal or ammonium hydroxide with alkali metal or ammonium nitrate is particularly effective in dissolving aluminum or magnesium.

Figure 1:
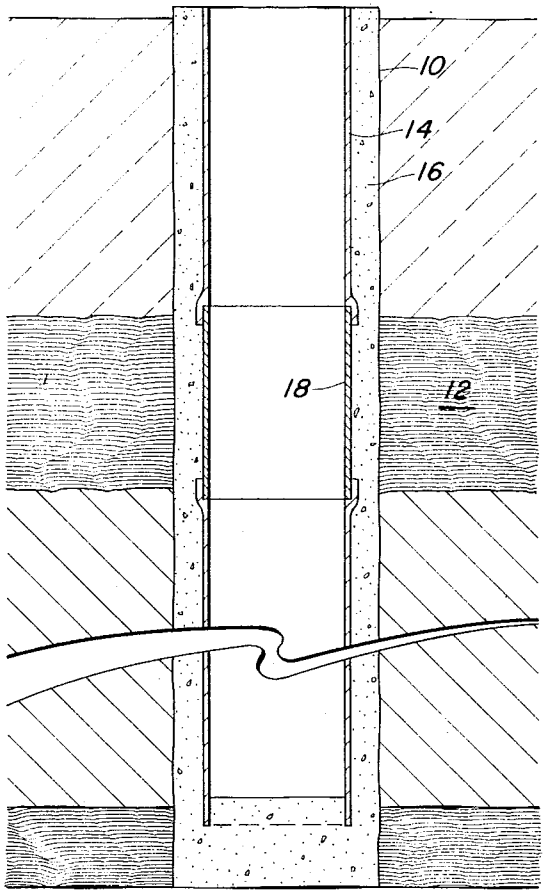
FIG. 1 is a cross sectional view of a cased and cemented wellbore having a soluble casing section opposite a selected formation.

Raferring to FIG. 1, a wellbore 10 traverses formation 12 and is cased with casing string 14 extending below formation 12. Casing string 14 is cemented with cement 16, and a section 18 of casing string 14 is spotted adjacent formation 12. Casing section 18 is formed of a material which is soluble in a selected chemical solution which can dissolve casing section 18 but not the rest of the casing.

As seen in FIG. 2, casing section 18 may be isolated with upper packer 20 and in some cases with a lower packer 22 prior to being contacted with the selected chemical solution which is injected through injection tubing 24.

The chemical solution is circulated through injection tubing 24 and up through return tubing 26 until the casing section has substantially dissolved. In many cases it will be desirable to run a section mill or reaming tool down the well to positively clean out any undissolved portions of casing section 18 and to remove the cement adjacent the formation as shown in FIG. 3, and to circulate out cuttings and any undissolvad pieces of casing section 18.

Figure 3:
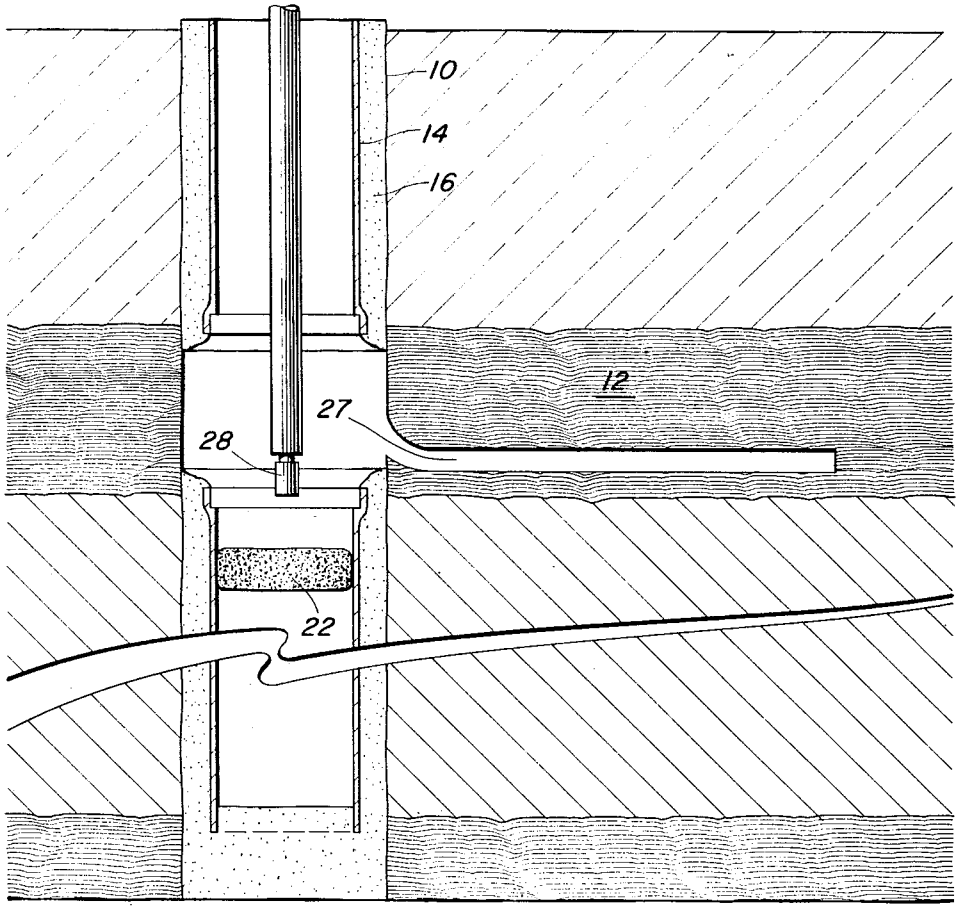
FIG. 3 is a cross sectional view illustrating a production string for producing fluid produced through a horizontal borehole through the selected formation.

As also shown in FIG. 3, a generally horizontal borehole 27 is then drilled through the window in the casing string, and appropriate completion procedures are carried out depending on whether the well is to be a producing well or an injection well, and whether additional producing or injection formations (not shown) are to be operated simultaneously with formation 12. A pump 28 is positioned adjacent or lo below formation 12, and is used to pump fluid produced from formation 12 up through tubing 26. If the well is to be used as an injection well, upper packer 20 would be left in place to facilitate pumping fluid into formation 12. Lower packer 22 or some other means, depending on what uses, if any, are made of the portion of the well below formation 12, is used to also facilitate injection into formation 12. Multiple horizontal boreholes (not shown) could be drilled into formation 12 if desired.

Drilling of generally horizontal boreholes into a formation from a vertical well traversing the formation can be carried out by any number of procedures utilizing various types of hardware depending on the turn radius of the vertical to horizontal section, the length of horizontal borehole to be drilled, and other factors. The present invention makes it possible to carry out the horizontal drilling through a chemically removed window in a casing string extending below the formation through which the horizontal borehole is to be drilled.

I claim:

1. In a process for drilling and completing a well traversing a formation wherein casing is set in the well to a point below said formation, wherein a section of casing that is more soluble in a selected chemical than the remainder of said casing is located in said casing adjacent said formation, and wherein said more soluble section of casing is contacted with said selected chemical solution in an amount and for a time sufficient to substantially dissolve said more soluble casing section, the improvement comprising:

(a) drilling at least one generally horizontal borehole segment into said formation through the opening created by dissolving said more soluble casing section.

2. The process of claim 1 wherein a pump is positioned in said well to pump produced fluids from said generally horizontal borehole segment to the surface.

3. The process of claim 1 wherein sealing means are positioned in said well above and below said formation, and fluid is injected into said formation through said generally horizontal borehole segment.

4. The process of claim 1 wherein, prior to drilling said generally horizontal borehole segment, a section mill is run in said well to remove any undissolved portion of said substantially dissolved casing section, and fluid is circulated through said well to remove solid particles therefrom.

5. The process of claim 1 wherein said more soluble casing section is made from material selected from the group consisting of aluminum, magnesium, and alloys of aluminum or magnesium.

6. The process of claim 5 wherein said selected chemical solution comprises a caustic solution.

7. The process of claim 6 wherein said selected chemical solution is a solution of sodium hydroxide and a dissolved nitrate salt.

* * * * *